US009642228B2

(12) United States Patent
Takeuchi

(10) Patent No.: US 9,642,228 B2
(45) Date of Patent: May 2, 2017

(54) LIGHT-EMITTING ELEMENT DRIVING CIRCUIT SYSTEM

(71) Applicant: Semiconductor Components Industries, LLC, Phoenix, AZ (US)

(72) Inventor: Takuya Takeuchi, Osaka (JP)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 667 days.

(21) Appl. No.: 14/099,995

(22) Filed: Dec. 8, 2013

(65) Prior Publication Data

US 2014/0091729 A1 Apr. 3, 2014
US 2016/0057840 A9 Feb. 25, 2016

Related U.S. Application Data

(63) Continuation of application No. 12/942,339, filed on Nov. 9, 2010, now Pat. No. 8,604,719.

(30) Foreign Application Priority Data

Nov. 9, 2009 (JP) ..... 2009-256232

(51) Int. Cl.
*H05B 37/02* (2006.01)
*G09G 3/34* (2006.01)
*H05B 33/08* (2006.01)

(52) U.S. Cl.
CPC ..... *H05B 37/0281* (2013.01); *G09G 3/3406* (2013.01); *H05B 33/0827* (2013.01); *H05B 33/0845* (2013.01); *G09G 2320/064* (2013.01)

(58) Field of Classification Search
None
See application file for complete search history.

(56) References Cited

U.S. PATENT DOCUMENTS 6,726,329 B2 * 4/2004 Li ..... G02B 27/283 345/46
6,867,757 B1 3/2005 Nakamura
7,642,724 B2 1/2010 Muto et al.
7,791,498 B2 * 9/2010 Park ..... G09G 3/3413 250/552

FOREIGN PATENT DOCUMENTS

CN 1265506 A 9/2000
JP 2008-251886 A 10/2008
JP 2008304694 A 12/2008
JP 2009032497 A 2/2009
JP 2009252939 A 10/2009

* cited by examiner

*Primary Examiner* — Dedei K Hammond
(74) *Attorney, Agent, or Firm* — Rennie William Dover

(57) ABSTRACT

A light-emitting element driving circuit system is provided in which a plurality of current paths, in each of which a light-emitting element and a switching element which is controlled to be switched ON and OFF for causing light to be emitted from the light-emitting element are connected in series, are placed in parallel to each other, wherein an ON time of each switching element is adjusted based on a light-emission period which is a period in which the light-emitting elements are caused to emit light in a circulating manner, such that a number of switching operations of each switching element is reduced.

21 Claims, 2 Drawing Sheets

LIGHT-EMITTING ELEMENT DRIVING CIRCUIT SYSTEM

CROSS-REFERENCE TO RELATED APPLICATIONS

The entire disclosure of Japanese Patent Application No. 2009-256232 filed on Nov. 9, 2009, including specification, claims, drawings, and abstract, is incorporated herein by reference in its entirety.

BACKGROUND

Technical Field

The present invention relates to a light-emitting element driving circuit system, and in particular, to a light-emitting element driving circuit system which drives a plurality of light-emitting elements.

Background Art

Recently, a light-emitting element driving circuit system is equipped in various electronic devices such as a portable phone. For example, Patent Literature 1 (JP 2008-251886 A) discloses a structure having a drive current supplying circuit which is connected in series with a light-emitting element between a first power supply and a second power supply, and which supplies a drive current to the light-emitting element according to a voltage on a control terminal, and a current determining circuit which determines and outputs a current according to an amount of output light of the light-emitting element. The structure further has a current-to-voltage converter circuit which converts a current determined by the current determining circuit into a voltage and outputs the converted voltage to the control terminal of the drive current supplying circuit when the control signal is in a first state, and which disconnects the output voltage terminal from the control terminal of the drive current supplying circuit when the control signal is in a second state. The structure also has a reset circuit which connects the control terminal of the drive current supplying circuit to the second power supply when the control signal is in the second state.

In some light-emitting element driving circuit systems, a plurality of light-emitting elements are placed in a matrix form, and light is sequentially emitted from each light-emitting element for a predetermined light emission period, so that light is emitted in a circulating manner When the predetermined light emission period is longer than a normally set period, if the light-emitting elements are caused to emit light in a circulating manner with the ON-OFF control of each switching element for light-emitting element connected to each light-emitting element being controlled with a preset ON time, a number of switching operations of each switching element for light-emitting element may become large, resulting in an increase in the current consumption of the light-emitting element driving circuit system.

SUMMARY

According to one aspect of the present invention, there is provided a light-emitting element driving circuit system in which a plurality of current paths, in each of which a light-emitting element and a switching element which is controlled to be switched ON and OFF for causing light to be emitted from the light-emitting element are connected in series, are placed in parallel to each other, wherein an ON time of each switching element is adjusted based on a light-emission period which is a period in which the light-emitting elements are caused to emit light in a circulating manner, such that a number of switching operations of each switching element is reduced.

According to another aspect of the present invention, there is provided a portable phone comprising the light-emitting element driving circuit system.

BRIEF DESCRIPTION OF THE DRAWINGS

A preferred embodiment of the present invention will be described in detail based on the following drawings, wherein.

DESCRIPTION OF EMBODIMENTS

Figure 1:
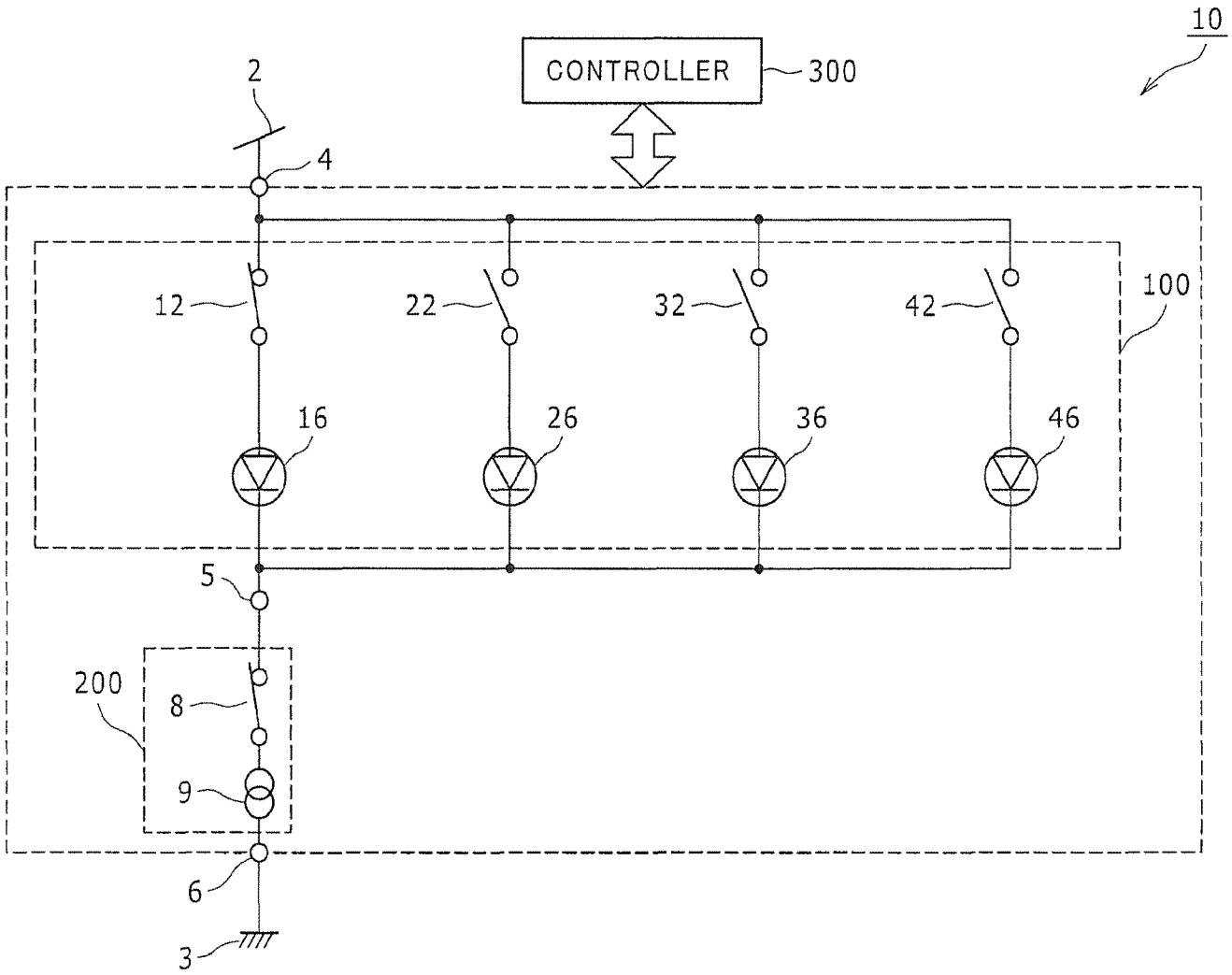
FIG. 1 is a diagram showing a light-emitting element driving circuit system according to a preferred embodiment of the present invention.

A preferred embodiment of the present invention will now be described in detail with reference to the attached drawings. In the following, similar elements in all drawings are assigned the same reference numeral, and will not be repeatedly described. In the description, reference numerals that are already mentioned will be referred to as necessary.

FIG. 1 is a diagram showing a light-emitting element driving circuit system 10. The light-emitting element driving circuit system 10 comprises a light-emission circuit unit 100, a common circuit unit 200, and a controller 300. In the following, the light-emitting element driving circuit system 10 will be described exemplifying a system which is equipped in a portable phone (In other words, cellular phone) and which drives light-emitting elements 16, 26, 36, and 46 which function as a backlight of a liquid crystal screen of the portable phone. The light-emission circuit unit 100 and the common circuit unit 200 will hereinafter also be collectively referred to as a light-emitting element driving circuit.

The light-emission circuit unit 100 is a circuit in which a plurality of current paths in each of which a light-emitting element and a switching element for the light-emitting element are connected in series are placed in parallel to each other between a power supply terminal 4 connected to an input power supply 2 and a common terminal 5. More specifically, in the light-emission circuit unit 100, a current path in which the light-emitting element 16 and a switching element for light-emitting element 12 are connected in series, a current path in which the light-emitting element 26 and a switching element for light-emitting element 22 are connected in series, a current path in which the light-emitting element 36 and a switching element for light-emitting element 32 are connected in series, and a current path in which the light-emitting element 46 and a switching element for light-emitting element 42 are connected in series, are connected and placed between the power supply terminal 4 and the common terminal 5, in parallel to each other.

The light-emitting elements 16, 26, 36, and 46 are circuit elements which emit light when a voltage is applied between an anode terminal (positive electrode) and a cathode terminal (negative electrode) in a forward direction. The light-emitting elements 16, 26, 36, and 46 have respective anode terminals connected to second terminals of the switching elements for light-emitting element 12, 22, 32, and 42, respectively, and the cathode terminals connected to the common terminal 5.

The switching elements for light-emitting element 12, 22, 32, and 42 are switching elements which are controlled to be switched ON and OFF by the controller 300, and comprise, for example, transistors. The switching elements for light-emitting elements 12, 22, 32, and 42 have first terminals connected to the power supply terminal 4 and respective second terminals connected to the anode terminals of the light-emitting elements 16, 26, 36, and 46, respectively.

The common circuit unit 200 is a circuit placed between the common terminal 5 and a ground terminal 6. A common switching element 8 is a switching element which is controlled to be switched ON and OFF by the controller 300, and comprises, for example, a transistor. The common switching element 8 has a first terminal connected to the common terminal 5 and a second terminal connected to a first terminal of a constant current source 9.

The constant current source 9 is a current source for driving the light-emitting elements 16, 26, 36, and 46 with a predefined drive current. The constant current source 9 has the first terminal connected to the second terminal of the common switching element 8 and a second terminal connected to the ground terminal 6 which is connected to the ground 3 and grounded.

The controller 300 is a control circuit having a function to control switching (ON-OFF control) of the switching elements for light-emitting elements 12, 22, 32, and 42, and the common switching element 8. With the switching control of the controller 300, the switching elements for light-emitting elements are switched in the order of the switching element for light-emitting element 12, the switching element for light-emitting element 22, the switching element for light-emitting element 32, and the switching element for light-emitting element 42, so that light emitting elements sequentially emit light in the order of the light-emitting element 16, the light-emitting element 26, the light-emitting element 36, and the light-emitting element 46. After the light-emitting element 46 emits light, the light-emitting elements again sequentially emit light in the order of the light-emitting element 16, the light-emitting element 26, the light-emitting element 36, and the light-emitting element 46. In other words, with the switching control of the controller 300 the switching elements for light-emitting elements 12, 22, 32, and 42, a circulating light emission of the light-emitting elements 16, 26, 36, and 46 can be realized.

A function to control light emission (lighting) of the light-emitting elements 16, 26, 36, and 46 by the controller 300 will now be described with reference to FIG. 2. The controller 300 may cause gradation lighting of the light-emitting elements 16, 26, 36, and 46 for a certain period in the overall period when the light-emitting elements 16, 26, 36, and 46 are lighted. The gradation lighting refers to a lighting state where the drive current values of the light-emitting elements 16, 26, 36, and 46 are changed in intervals of a predetermined light-emission period of L, 2L, 3L, 4L, . . . 9L, to smoothly change the brightness.

Figure 2A:
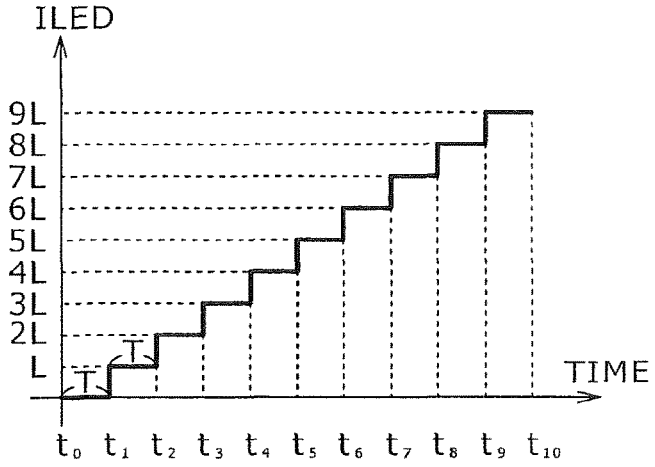
FIGS. 2A and 2B are current characteristic diagrams showing a change of a drive current value with respect to each period in a gradation lighting period in the preferred embodiment of the present invention.

FIG. 2A is a diagram showing a current characteristic of a gradation lighting period in which the drive current value (ILED) is changed from L to 9L at an interval of each light-emission period T. In FIG. 2A, in the light-emission period T from time t0 to time t1, because ILED is maintained at 0, the light-emitting elements 16, 26, 36, and 46 are not lighted.

In a light-emission period T from time t1 to time t2, the light-emitting elements 16, 26, 36, and 46 are driven with a drive current value ILED of L. Here, in the light-emitting period T from time t1 to time t2, not all of the light-emitting elements 16, 26, 36, and 46 emit light in all periods. Specifically, in the light-emission period T from time t1 to time t2, only the light-emitting element 16 is switched ON in the period of the first ¼T, only the light-emitting element 26 adjacent to the light-emitting element 16 is switched ON in the period of the next ¼T, only the light-emitting element 36 adjacent to the light-emitting element 26 is switched ON in the period of the next ¼T, and only the light-emitting element 46 adjacent to the light-emitting element 36 is switched ON in the period of the remaining ¼T. In other words, the controller 300 switches the ON control of the switching element for light-emitting element 12, the switching element for light-emitting element 22, the switching element for light-emitting element 32, and the switching element for light-emitting element 42 with a period of ¼T, so that light is sequentially emitted from the light-emitting element 16, the light-emitting element 26, the light-emitting element 36, and the light-emitting element 46. Here, the controller 300 has a function to determine the ON time of the switching elements for light-emitting elements 12, 22, 32, and 42, which will be described in detail later.

After the light-emission period T from time t1 to time t2 is completed, the period transitions to the next light-emission period T from time t2 to time t3, in which light is emitted from the light-emitting elements 16, 26, 36, and 46 with a drive current value ILED of 2L. In the light-emission period T from time t1 to time t2 described above, the light is emitted from the light emitting elements in the order of the light-emitting element 16, the light-emitting element 26, the light emitting element 36, and the light-emitting element 46, and the light-emission period T is completed after the light-emitting element 46 emits light. In the light-emission period T from time t2 to time t3, the light is emitted from the light-emitting elements again in the order of the light-emitting element 16, the light-emitting element 26, the light-emitting element 36, and the light-emitting element 46. Thus, in a combined period from time t1 through time t3, the controller 300 causes light to be emitted in a circulating manner from the light-emitting elements 16, 26, 36, and 46.

In the light-emission period T from time t2 to time t3 also, the controller 300 controls switching of the switching elements for light-emitting elements 12, 22, 32, and 42 such that the light-emitting elements 16, 26, 36, and 46 are switched and lighted with a period of ¼T. In addition, in FIG. 2A, the circulating light emission of the light-emitting elements 16, 26, 36, and 46 is continued while the ILED is changed, at an interval of the light-emission period T, to 3L, 4L, 5L, 6L, 7L, 8L, and 9L in the period from time t3 to time t10. Because of this, in the gradation lighting period, gradation lighting of the light-emitting elements 16, 26, 36, and 46 is achieved by the control of the controller 300.

Figure 2B:
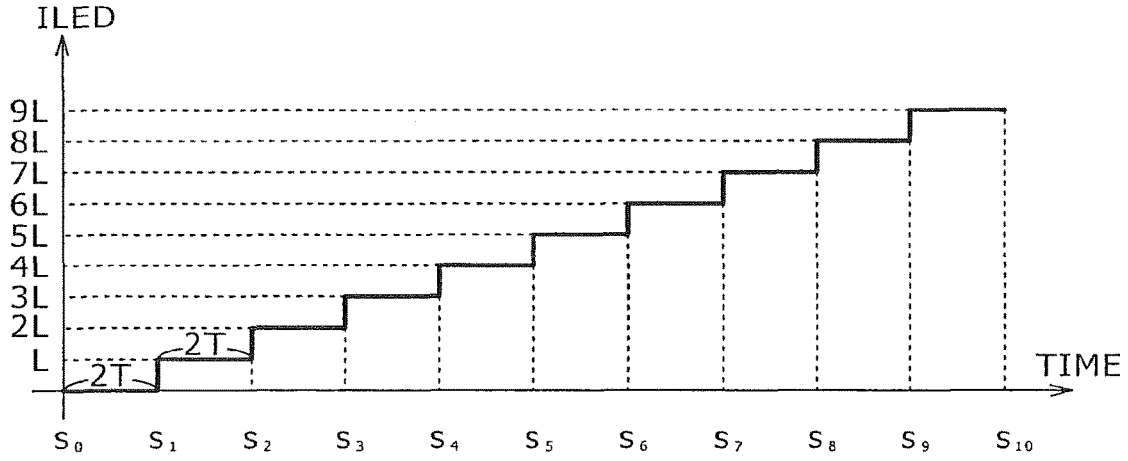

In FIG. 2A, the gradation lighting period of the light-emitting elements 16, 26, 36, and 46 is realized from time t0 to time t10 (with the interval of each light-emission period being T). FIG. 2B shows a current characteristic diagram where the gradation lighting period is twice that of FIG. 2A and is from time s0 to time s10 (with the interval of each light-emission period being 2T).

The controller 300 has a function to set a value obtained by dividing the light-emission period t of the gradation lighting period by a total number of the plurality of light-emitting elements m (t/m) as the ON time of each switching element for light-emitting elements connected to each light-emitting element. Specifically, the controller 300 has a function, in the example configuration of FIG. 2A, to execute adjustment to set a period ¼T obtained by dividing the light-emission period of the gradation lighting period (t=T) by the total number (m=4) of light-emitting elements 16, 26, 36, and 46 for circulation light-emission as the ON period of each element of the switching elements for light-emitting elements 12, 22, 32, and 42 connected to the light-emitting elements 12, 22, 32, and 42. The controller also has a function to change the switching control such that, when the light-emission period in the gradation lighting period is changed from FIG. 2A to FIG. 2B, a period ½T obtained by dividing the light-emission period after the change (t =2T) by the total number (m=4) of the light-emitting elements 16, 26, 36, and 46 is set as the ON period of the switching elements for light-emitting elements 12, 22, 32, and 42.

An operation of the light-emitting element driving circuit system 10 having the above-described structure will now be described with reference to FIGS. 1 and 2. According to the light-emitting element driving circuit system 10, ¼T obtained by dividing each light-emission period T of the gradation lighting period by the total number 4 of the light-emitting elements 16, 26, 36, and 46 is determined as the ON time of the switching elements for light-emitting elements 12, 22, 32, and 42, and the system is adjusted such that a number of switching operations in each light-emission period T is reduced. With this configuration, the circulating light-emission can be realized by the light-emitting elements 16, 26, 36, and 46 with a low current consumption.

In addition, according to the light-emitting element driving circuit system 10, when the light-emission period of the gradation lighting period is changed from T to 2T, the ON time of each switching element for light-emitting element is changed from ¼T to ½T, and when the light-emission period of the gradation lighting period is changed from T to 3T, the ON time of each switching element for light-emitting element is changed from ¼T to ¾T.

For comparison, a case where the ON time of each switching element for light-emitting element is not changed when the light-emission period in the gradation lighting period is changed from T to 2T will now be described. Because the ON time is ¼T, in each light-emission period 2T, light is emitted from the light-emitting elements in the order of the light-emitting element 16, the light-emitting element 26, the light-emitting element 36, the light-emitting element 46, the light-emitting element 16, the light-emitting element 26, the light-emitting element 36, and the light-emitting element 46. Therefore, a number of switching operations per each light-emission period 2T is twice for each switching element for the light-emitting element a when the ON time is maintained at ¼T.

On the other hand, with the light-emitting element driving circuit system 10, because the ON time of each of the switching elements for light-emitting element 12, 22, 32, and 42 is changed to ½T, in each light-emission period 2T, the light is emitted from the light-emitting elements in the order of the light-emitting element 16, the light-emitting element 26, the light-emitting element 36, and the light-emitting element 46. In other words, when the ON time is changed to ½T, the number of switching operations for each switching element for a light-emitting element is once. As described, according to the light-emitting element driving circuit system 10, even when the light-emission period is changed, the ON time can be changed to reduce the number of switching operations of each switching element for a light-emitting element, and thus an increase in the current consumption can be inhibited.

As described, according to the light-emitting element driving circuit system 10, the ON time is adjusted based on each light-emission period t (for example, T) of the gradation lighting period so that the number of switching operations of each of the switching elements for light-emitting elements 12, 22, 32, and 42 is reduced, and when each light-emission period t of the gradation lighting period is changed, for example, from T to nT (where n is an integer), the ON time for each of the switching elements for light-emitting elements 12, 22, 32, and 42 is changed to nT/m (where n and m are integers and m is 4 in the example configuration of FIG. 2), so that the number of switching operations of the switching elements for light-emitting elements 12, 22, 32, and 42 in each light-emission period is not increased, and as a result, an increase in the current consumption can be inhibited.

What is claimed is:

1. A method for driving light-emitting elements, comprising:

providing m current paths coupled in a parallel configuration, wherein each current path includes a light-emitting element and wherein m is an integer;

sequentially turning on and off a plurality of light-emitting elements in the m current paths, including turning on and off a first light emitting element of the plurality of light emitting elements in a first current path of the m current paths then turning on and off a second light-emitting element of the plurality of light emitting elements in a second current path of the m current paths, wherein each light-emitting element is illuminated for a first light-emission time and wherein a sum of the first light-emission times of the m light-emitting elements is a first light emission period; and adjusting the first light-emission time to a second light emission time in response to a change in the first light-emission period.

2. The method of claim 1, wherein providing the m current paths includes providing the first current path having a first light-emitting diode coupled to a first switch.

3. The method of claim 1, wherein sequentially turning on and off the first and second light emitting elements in the m current paths comprises turning on and off the first and second light emitting elements in a circulating manner.

4. The method of claim 3, wherein turning on the first and second light emitting elements in the circulating manner includes:

turning on each of the light emitting elements during a first light-emission period in a defined order; and turning on each of the light emitting elements during a second light-emission period in the defined order.

5. The method of claim 4, wherein:

providing the m current paths coupled in a parallel configuration includes providing first, second, third, and fourth current paths that include first, second, third, and fourth light emitting elements, respectively;

turning on and off each of the light emitting elements during the first light-emission period in the defined order includes turning on and off the first light emitting element, then turning on and off the second light emitting element, then turning on and off the third light emitting element, then turning on and off the fourth light emitting element during the first light-emission period; and turning on and off each of the light emitting elements during the second light-emission period in the defined order includes turning on and off the first light emitting element, then turning on and off the second light emitting element, then turning on and off the third light emitting element, then turning on and off the fourth light emitting element during the second light-emission period.

6. The method of claim 4, wherein:

providing the m current paths coupled in a parallel configuration includes providing first, second, third, and fourth current paths that include first, second, third, and fourth light emitting elements, respectively;

turning on and off each of the light emitting elements during the first light-emission period in the defined order includes turning on and off the third light emitting element, then turning on and off the fourth light emitting element, then turning on and off the first light emitting element, then turning on and off the second light emitting element during the first light-emission period; and turning on and off each of the light emitting elements during the second light-emission period in the defined order includes turning on and off the third light emitting element, then turning on and off the fourth light emitting element, then turning on and off the first light emitting element, then turning on and off the second light emitting element during the second light-emission period.

7. The method of claim 1, wherein sequentially turning on and off the light-emitting elements in the m current paths includes sequentially injecting a current through the m current paths.

8. The method of claim 1, wherein sequentially turning on and off the light-emitting elements in the m current paths includes sequentially injecting a first current through the m current paths during a first light-emission period and sequentially injecting a second current through the m current paths during a second light-emission period, wherein the second current is larger than the first current.

9. A method for driving light emitting elements, comprising:

generating a first plurality of light signals from a plurality of light emitting elements in response to sequentially injecting current into a plurality of current paths during a first light-emission period and in accordance with a first injection sequence, wherein sequentially injecting the current into the plurality of current paths includes closing a first switch to inject the current into a first current path of the plurality of current paths, opening the first switch, and closing a second switch to inject the current into a second current path of the plurality of current paths, wherein each of the first plurality of light signals is on for a first light-emission time and wherein a sum of the first light-emission times is the first light-emission period; and generating a second plurality light signals from the plurality of light emitting elements in response to sequentially injecting current into the plurality of current paths during a second light-emission period and in accordance with the first injection sequence, wherein sequentially injecting the current into the plurality of current paths includes closing the first switch to inject the current into the first current path of the plurality of current paths, opening the first switch, and closing the second switch to inject the current into the second current path of the plurality of current paths, wherein each of the second plurality of light signals is on for a second light-emission time and wherein a sum of the second light-emission times is the second light-emission period.

10. The method of claim 9, wherein sequentially injecting the current into the plurality of current paths during the first light emission period includes sequentially injecting the current at a first current level and wherein sequentially injecting the current into the plurality of current paths during the second light emission period includes sequentially injecting the current at a second current level, the second current level greater than the first current level.

11. The method of claim 9, wherein each current path includes a light emitting element coupled in series with a switch.

12. The method of claim 9, further including providing the plurality of current paths to include first, second, third, and fourth current paths and wherein the first injection sequence includes injecting the current into the first current path, then the second current path, then the third current path, then the fourth current path.

13. The method of claim 9, further including providing the plurality of current paths to include first, second, third, and fourth current paths and wherein the first injection sequence includes injecting the current into the third current path, then the first current path, then the fourth current path, then the second current path.

14. The method of claim 9, wherein sequentially injecting the current into the plurality of current paths during the first light-emission period includes injecting the current at a first current level and wherein sequentially injecting the current into the plurality of current paths during the second light-emission period includes injecting the current at a second current level, the second level greater than the first level.

15. The method of claim 9, further including setting the light-emission period as a sum of the times that the plurality of light emitting elements emit light in a cycle.

16. A method for driving light-emitting elements, comprising sequentially turning on m light-emitting elements, where m is an integer, wherein each light-emitting element is on for a first light-emission time and wherein a sum of the first light-emission times of the m light-emitting elements is a first light-emission period, and adjusting the first light-emission time to a second light-emission time in response to a change in the first light-emission period.

17. The method of claim 16, further including sequentially turning on the m light-emitting elements in a circulating manner, wherein each light-emitting element is turned on and off during the first light-emission period.

18. The method of claim 17, further including turning on the m light-emitting elements in response to a current at a first level during the first light-emission period and turning on the m light-emitting elements in response to the current at a second level during a second light-emission period.

19. The method of claim 17, further including turning on the m light-emitting elements in response to a current at a plurality of current levels, wherein in a first cycle the m light-emitting elements are turned on in response the current being at a first level, in a second cycle the m light-emitting elements are turned on response to the current being at a second level, and wherein in a third cycle the m light-emitting elements are turned on in response to the current being at a third level.

20. The method of claim 17, further including turning on the m light-emitting elements in response to a current at a plurality of current levels, wherein each current level occurs during a corresponding cycle.

21. The method of claim 16, wherein turning on the m light-emitting elements includes closing a first switch coupled to a first light emitting element of the m light emitting elements to begin the first light-emission time and opening the first switch to end the first light-emission time.

* * * * *